US010753640B2

(12) United States Patent
Koike et al.

(10) Patent No.: US 10,753,640 B2
(45) Date of Patent: Aug. 25, 2020

(54) HEAT SOURCE UNIT

(71) Applicant: DAIKIN INDUSTRIES, LTD., Osaka-shi, Osaka (JP)

(72) Inventors: Fumiaki Koike, Osaka (JP); Shigeki Kamitani, Osaka (JP); Takuya Horita, Osaka (JP); Daiki Hirawa, Osaka (JP); Yuusuke Tanaka, Osaka (JP); Taichi Koshiji, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 0 days.

(21) Appl. No.: 16/332,149

(22) PCT Filed: Jul. 24, 2017

(86) PCT No.: PCT/JP2017/026613
§ 371 (c)(1),
(2) Date: Mar. 11, 2019

(87) PCT Pub. No.: WO2018/061426
PCT Pub. Date: Apr. 5, 2018

(65) Prior Publication Data

US 2019/0338985 A1 Nov. 7, 2019

(30) Foreign Application Priority Data

Sep. 29, 2016 (JP) ..... 2016-191398

(51) Int. Cl.
*F24F 13/20* (2006.01)
*F24F 1/10* (2011.01)
(Continued)

(52) U.S. Cl.
CPC ..... *F24F 13/20* (2013.01); *F24F 1/10* (2013.01); *F24F 1/16* (2013.01); *F24F 1/22* (2013.01);
(Continued)

(58) Field of Classification Search
CPC ..... F24F 1/10; F24F 1/16; F24F 1/22; F24F 1/52; F24F 1/56; F24F 2013/202; F24F 13/20
See application file for complete search history.

(56) References Cited

U.S. PATENT DOCUMENTS

2009/0277205 A1 11/2009 Matsuda et al.
2014/0224457 A1* 8/2014 Suzuki ..... F24F 1/16 165/121
(Continued)

FOREIGN PATENT DOCUMENTS

CN 1719146 A 1/2006
CN 205505231 U 8/2016
(Continued)

OTHER PUBLICATIONS

International Search Report, issued in PCT/JP2017/026613, PCT/ISA/210, dated Sep. 19, 2017.
(Continued)

*Primary Examiner* — Elizabeth J Martin
(74) *Attorney, Agent, or Firm* — Birch, Stewart, Kolasch & Birch, LLP

(57) ABSTRACT

A bottom frame (50) which constitutes a bottom surface of a casing (40) is divided into a main bottom frame (51) where a first compressor (11) is to be provided and a sub bottom frame (55) where a second compressor (21) is to be provided. The main bottom frame (51) is further divided into a first bottom frame (52) and a second bottom frame (53). The first compressor (11) is to be provided on the first bottom frame (52). A refrigerant circuit component (47) to be replaced or added in accordance with a capability or a function is to be provided on the second bottom frame (53).

4 Claims, 3 Drawing Sheets

(51) Int. Cl.

| | |
|---|---|
| ***F24F 1/16*** | (2011.01) |
| ***F24F 1/22*** | (2011.01) |
| ***F24F 1/50*** | (2011.01) |
| ***F24F 1/56*** | (2011.01) |

(52) U.S. Cl.
CPC ..... *F24F 1/50* (2013.01); *F24F 1/56* (2013.01); *F24F 2013/202* (2013.01)

(56) References Cited

U.S. PATENT DOCUMENTS

| | | | |
|---|---|---|---|
| 2015/0338141 | A1 | 11/2015 | Troxell et al. |
| 2016/0178248 | A1 | 6/2016 | Lim et al. |
| 2019/0120506 | A1 | 4/2019 | Koike et al. |

FOREIGN PATENT DOCUMENTS

| | | | |
|---|---|---|---|
| JP | 2007-71517 | A | 3/2007 |
| JP | 2007-93151 | A | 4/2007 |
| JP | 2010-159924 | A | 7/2010 |
| JP | 2011-158137 | A | 8/2011 |
| JP | 2012-2503 | A | 1/2012 |
| WO | WO 2017/183601 | A1 | 10/2017 |

OTHER PUBLICATIONS

Notification of Reasons for Refusal for Japanese Application No. 2016-191398, dated Sep. 12, 2017.
The Decision to Grant a Patent has been received for Japanese Application No. 2016-191398 dated Dec. 26, 2017.
Written Opinion of the International Searching Authority, issued in PCT/JP2017/026613, PCT/ISA/237, dated Sep. 19, 2017.

* cited by examiner

HEAT SOURCE UNIT

TECHNICAL FIELD

The present invention relates to a heat source unit.

BACKGROUND ART

An air conditioner comprised of a heat source unit and a utilization unit connected to each other with pipes has been known (see, e.g., Patent Document 1).

Patent Document 1 discloses that refrigerant circuit components are provided in a casing, and that a bottom frame which constitutes a bottom surface of the casing is divided in the front-to-back direction.

CITATION LIST

Patent Documents

Patent Document 1: Japanese Unexamined Patent Publication No. 2011-158137.

SUMMARY OF THE INVENTION

Technical Problem

However, the known heat source unit is designed without taken into account possible addition of another compressor for the purpose of increasing an operating capacity. Specifically, according to the design of the known heat source unit, no consideration is given to issues involved in the addition of another compressor: to which of the divided bottom frames the additional compressor is to be mounted; and which bottom frame is to be increased in size in order to place the additional compressor, etc. In other words, according to the known heat source unit, arrangements of all the refrigerant circuit components including the compressor to be added are reconsidered, and based on the result of the reconsideration, the arrangements of the refrigerant circuit components and the size of the casing are changed.

However, such a technique requires reconsideration of the arrangements of all the refrigerant circuit components including the compressor to be added, every time a compressor is added. It is therefore impossible to easily determine where to place the additional compressor and to easily change the size of the casing.

In addition, since the compressor is a unit which generates vibration, the vibration of the entire module including the compressor needs to be reanalyzed in order to investigate the influence of the vibration on the surrounding refrigerant circuit components, which costs time and effort.

In view of the foregoing background, it is an object of the present invention to reduce the number of work steps in adding a compressor.

Solution to the Problem

Aspects of the present disclosure are directed to a heat source unit which includes a casing (40) in which a first compressor (11) and a second compressor (21) are to be provided. In the heat source unit, the following measures are taken.

That is, a first aspect of the present disclosure is characterized in that a bottom frame (50) which constitutes a bottom surface of the casing (40) is divided into a main bottom frame (51) where the first compressor (11) is to be provided and a sub bottom frame (55) where the second compressor (21) is to be provided.

In the first aspect, the bottom frame (50) of the casing (40) is divided into the main bottom frame (51) where the first compressor (11) is to be provided and the sub bottom frame (55) where the second compressor (21) is to be provided.

Thus, it is possible to reduce the number of work steps in adding the second compressor (21) in addition to the first compressor (11) in order to increase the operating capacity of the heat source unit (2).

Specifically, if, for example, the second compressor (21) is to be additionally mounted on the bottom frame which is configured as a single frame and on which the first compressor (11) is mounted, such addition of the second compressor (21) may require reconsideration of a layout of the first compressor (11) and the second compressor (21) on the bottom frame, and may also require analysis of the influence of the vibration of the second compressor (21) on the first compressor (11) every time another compressor is added, which costs time and effort.

In contrast, according to the aspect of the present disclosure, the bottom frame is divided into the main bottom frame (51), where the first compressor (11) is mounted, and the sub bottom frame (55), where the second compressor (21) is to be mounted, which makes it possible to add the second compressor (21) without changing the layout of the first compressor (11).

Moreover, the aspect of the present invention makes it possible to perform vibration analyses, independently of each other in advance, of the main bottom frame (51) where the first compressor (11) is mounted, and of the sub bottom frame (55) where the second compressor (21) is mounted. Such vibration analyses eliminate the need to take account of the influence of the vibration of the second compressor (21) after the addition of the second compressor (21) into the casing (40), which contributes to improving the workability.

A second aspect is an embodiment of the first aspect. In the second aspect, the main bottom frame (51) is divided into a first bottom frame (52) where the first compressor (11) is to be provided, and a second bottom frame (53) where a refrigerant circuit component (47) to be replaced or added in accordance with a capability or a function is to be provided.

In the second aspect, the main bottom frame (51) is divided into the first bottom frame (52) where the first compressor (11) is to be provided, and the second bottom frame (53) where the refrigerant circuit component (47) is to be provided.

This configuration contributes to improving the workability because it is only necessary to change the arrangement of the refrigerant circuit component (47) mounted on the second bottom frame (53) and the size of the casing (40) in replacing or adding the refrigerant circuit component (47) in accordance with the capability and function.

A third aspect is an embodiment of the first or second aspect. In the third aspect, a first heat-source-side heat exchanger (13) and a second heat-source-side heat exchanger (23) are provided on the main bottom frame (51) and the sub bottom frame (55), respectively.

In the third aspect, the provision of the first heat-source-side heat exchanger (13) and the second heat-source-side heat exchanger (23) on the main bottom frame (51) and the sub bottom frame (55), respectively, allows routing, in advance, of the pipes connected to the first compressor (11) and the first heat-source-side heat exchanger (13) and the pipes connected to the second compressor (21) and the second heat-source-side heat exchanger (23), and therefore eliminates the need to change the arrangement and shapes of those pipes after the second compressor (21) is added.

The above-mentioned configuration also makes it possible to perform, in advance, vibration analyses of the main bottom frame (51) including the first compressor (11) and the first heat-source-side heat exchanger (13) and of the sub bottom frame (55) including the second compressor (21) and the second heat-source-side heat exchanger (23). It is thus no longer necessary to reanalyze the vibration of the device as a whole after the addition of the second compressor (21), which contributes to improving the workability.

In addition, the first heat-source-side heat exchanger (13) placed along the outer peripheral edge of the main bottom frame (51) and the second heat-source-side heat exchanger (23) placed along the outer peripheral edge of the sub bottom frame (55) may have an increased heat exchange area, compared with a case in which a single heat-source-side heat exchanger is placed along the entire outer peripheral edge of the bottom frame (50).

The two heat-source-side heat exchangers, namely the first heat-source-side heat exchanger (13) and the second heat-source-side heat exchanger (23) contribute to shortening the flow path length per heat-source-side heat exchanger, which is beneficial in reducing the pressure loss.

Advantages of the Invention

According to an aspect of the present disclosure, it is possible to reduce the number of work steps in adding the second compressor (21) besides the first compressor (11) in order to increase the operating capacity of the heat source unit (2).

DESCRIPTION OF EMBODIMENTS

An embodiment of the present invention will now be described in detail with reference to the drawings. Note that the following description of an embodiment is merely an example in nature, and is not intended to limit the scope, applications, or use of the present invention.

<Configuration of Air Conditioner>

Figure 1:
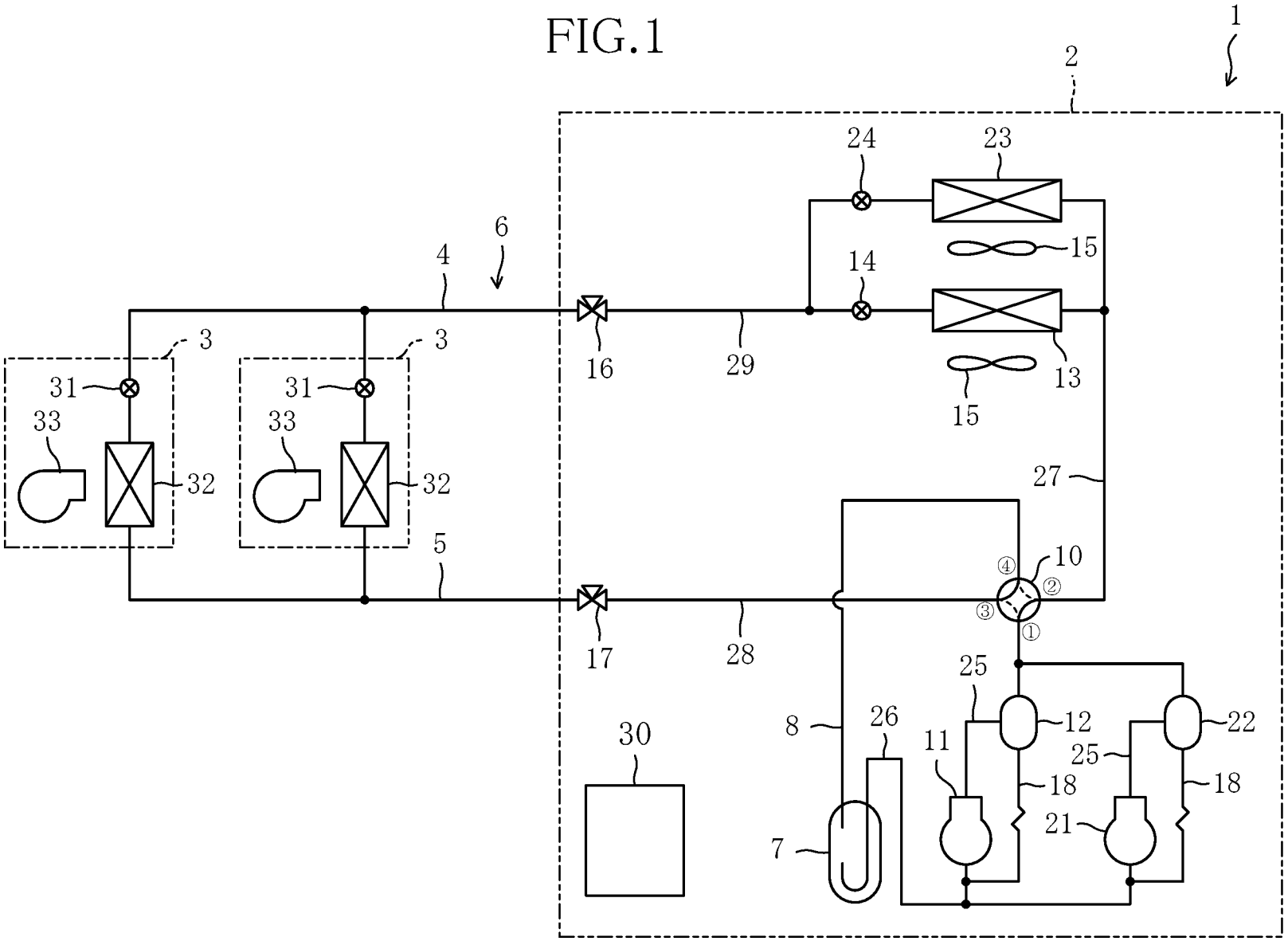
FIG. 1 is a diagram generally illustrating a configuration of an air conditioner employing a heat source unit according to a first embodiment.

As illustrated in FIG. 1, the air conditioner (1) is capable of heating and cooling indoor air in, for example, a building by performing a vapor compression refrigeration cycle. The air conditioner (1) is comprised of, as its main components, a heat source unit (2) and two utilization units (3) connected to the heat source unit (2). Note that the number of the utilization units (3) is merely an example, and is not limited to two.

The heat source unit (2) and the two utilization units (3) are connected to each other via a liquid-refrigerant connection pipe (4) and a gas-refrigerant connection pipe (5). That is, a vapor compression refrigerant circuit (6) in the air conditioner (1) is configured by the heat source unit (2) and the utilization units (3) connected to each other via the liquid-refrigerant connection pipe (4) and the gas-refrigerant connection pipe (5).

The heat source unit (2) is installed outside the indoor space (on the roof of a building, near a wall surface of a building, or a machine chamber, etc.) and forms part of the refrigerant circuit (6). The heat source unit (2) includes, as main components, an accumulator (7), a first compressor (11) and a second compressor (21), a first oil separator (12) and a second oil separator (22), a four-way switching valve (10), a first heat-source-side heat exchanger (13) and a second heat-source-side heat exchanger (23), a first heat-source-side expansion valve (14) and a second heat-source-side expansion valve (24), two heat-source-side fans (15), a liquid-side shutoff valve (16), and a gas-side shutoff valve (17).

The first compressor (11) and the second compressor (21) are fluid machines for compressing the refrigerant, and are configured, for example, as high-pressure dome type scroll compressors. The first compressor (11) is a main unit that is originally built in the heat source unit (2). The second compressor (21) is a sub unit that is added to increase the operating capacity of the heat source unit (2). The first compressor (11) and the second compressor (21) are connected in parallel with each other.

Discharge pipes (25) connected to the first compressor (11) and the second compressor (21) merge with each other so as to be connected to a first port of the four-way switching valve (10). The first oil separator (12) is connected to an intermediate portion of the discharge pipe (25) of the first compressor (11). The second oil separator (22) is connected to an intermediate portion of the discharge pipe (25) of the second compressor (21).

The first oil separator (12) and the second oil separator (22) are intended to separate the refrigerating machine oil from the refrigerant that has been discharged from the first compressor (11) and the second compressor (21). The refrigerating machine oil separated by the first oil separator (12) and the second oil separator (22) is returned to the suction side of the first compressor (11) and the suction side of the second compressor (21), respectively, via capillary tubes (18).

A suction pipe (26), which is connected to the suction side of the first compressor (11) and the suction side of the second compressor (21), is connected to the accumulator (7). The accumulator (7) temporarily stores the refrigerant before being sucked into the first compressor (11) and the second compressor (21). The suction pipe (26) extends from the accumulator (7) and is branched so as to be connected to the first compressor (11) and the second compressor (21).

The four-way switching valve (10) is switchable between a state (indicated by the solid curves in FIG. 1) in which the first port communicates with a second port, and a third port communicates with a fourth port, and a state (indicated by the dashed curves in FIG. 1) in which the first port communicates with the third port, and the second port communicates with the fourth port. The flowing direction of the refrigerant is changed in this manner, which allows the utilization unit (3) to perform a cooling or heating operation.

The first port of the four-way switching valve (10) is connected to the first compressor (11) and the second compressor (21) via the discharge pipes (25). The second port of the four-way switching valve (10) is connected to the first heat-source-side heat exchanger (13) and the second heat-source-side heat exchanger (23) via a gas pipe (27). The third port of the four-way switching valve (10) is connected to the gas-side shutoff valve (17) via a gas pipe (28). The fourth port of the four-way switching valve (10) is connected to the accumulator (7) via an inlet pipe (8).

Each of the first heat-source-side heat exchanger (13) and the second heat-source-side heat exchanger (23) is configured, for example, as a cross-fin type fin-and-tube heat exchanger. The heat-source-side fans (15) are disposed near the first heat-source-side heat exchanger (13) and the second heat-source-side heat exchanger (23). The first heat-source-side heat exchanger (13) and the second heat-source-side heat exchanger (23) are configured to exchange heat between the refrigerant and air taken by the heat-source-side fans (15).

Liquid pipes (29) connected to the first heat-source-side heat exchanger (13) and the second heat-source-side heat exchanger (23) merge with each other so as to be connected to the liquid-side shutoff valve (16). The first heat-source-side expansion valve (14) is connected to an intermediate portion of the liquid pipe (29) connected to the first heat-source-side heat exchanger (13). The second heat-source-side expansion valve (24) is connected to an intermediate portion of the liquid pipe (29) connected to the second heat-source-side heat exchanger (23). Each of the first heat-source-side expansion valve (14) and the second heat-source-side expansion valve (24) is configured as an electronic expansion valve.

The utilization unit (3) is installed in an indoor space (such as a living room or a space under the roof), and forms part of the refrigerant circuit (6). The utilization unit (3) includes, as main components, a utilization-side expansion valve (31), a utilization-side heat exchanger (32), and a utilization-side fan (33).

The liquid-refrigerant connection pipe (4) and the gas-refrigerant connection pipe (5) are refrigerant pipes which are installed on site when the air conditioner (1) is installed at an installation place of a building or the like. One end of the liquid-refrigerant connection pipe (4) is connected to the liquid-side shutoff valve (16) of the heat source unit (2), and the other end of the liquid-refrigerant connection pipe (4) is connected to the liquid side end of the utilization-side expansion valve (31) of the utilization unit (3).

One end of the gas-refrigerant connection pipe (5) is connected to the gas-side shutoff valve (17) of the heat source unit (2), and the other end of the gas-refrigerant connection pipe (5) is connected to the gas side end of the utilization-side heat exchanger (32) of the utilization unit (3).

The utilization-side heat exchanger (32) is configured, for example, as a cross-fin type fin-and-tube heat exchanger. The utilization-side expansion valve (31) is configured as an electronic expansion valve. The utilization-side fan (33) is disposed near the utilization-side heat exchanger (32). The utilization-side heat exchanger (32) is configured to exchange heat between the refrigerant and air taken by the utilization-side fan (33).

Each component and each valve of the heat source unit (2) and the utilization unit (3) are controlled by a controller (30).

(Configuration of Heat Source Unit)

Figure 2:
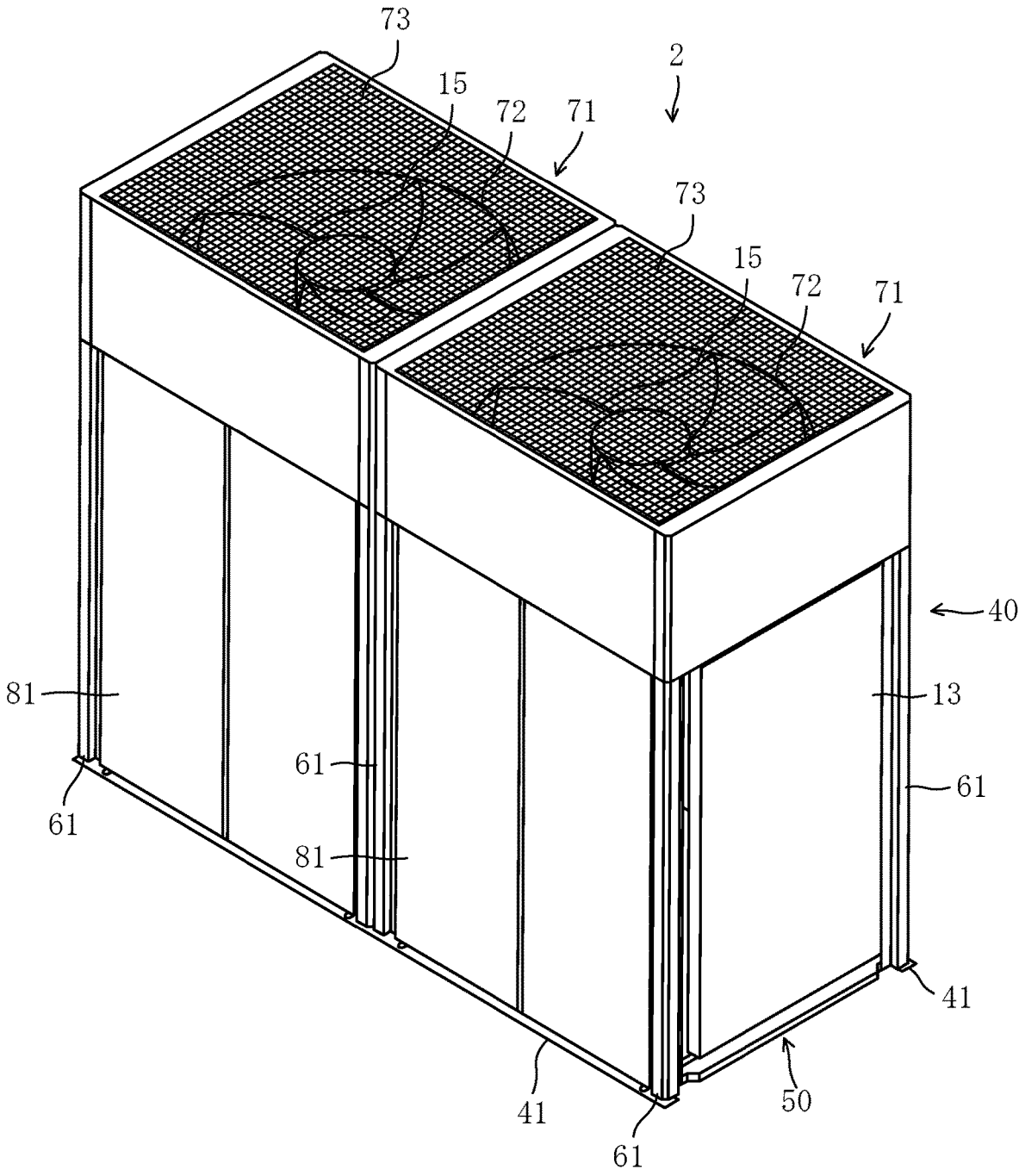
FIG. 2 is a diagram illustrating a perspective view of an appearance of the heat source unit.

As illustrated in FIG. 2, the heat source unit (2) has a so-called upward blowing type structure in which air is taken from below into a casing (40) having substantially a rectangular parallelepiped box-like shape, and the air is blown out of the casing (40) from above.

In the following description, the terms "upper," "lower," "left," "right," "front," "rear," "back," "front surface" and "rear surface" refer to directions when the heat source unit (2) shown in FIG. 2 is viewed from the front (from diagonal left with respect to the drawing) unless otherwise specified.

As illustrated in FIG. 2, the casing (40) includes, as main components, a pair of installation legs (41) extending in the right-to-left direction, a bottom frame (50) placed across the pair of installation legs (41) and constituting a bottom surface of the casing (40), supports (61) vertically extending from corner positions and substantially middle positions in the right-to-left direction of the bottom frame (50), fan modules (71) attached to the upper ends of the supports (61), and front panels (81).

Each of the fan modules (71) is an assembly of the heat-source-side fan (15) and a bell mouth (72) which are accommodated in a box-like component having substantially a rectangular parallelepiped shape with its upper and lower ends open. A blow-out grille (73) is provided at the upper end opening.

The front panels 81 are placed across the supports (61) on the front side, and constitute the front surface of the casing (40).

In some cases, a component forming part of the refrigerant circuit (6) and included in the heat source unit (2) may be replaced or added in accordance with the capability or function. The present embodiment describes a case in which the second compressor (21) is added to the heat source unit (2), in addition to the first compressor (11), in order to increase the operating capacity of the heat source unit (2).

If, for example, the second compressor (21) is to be additionally mounted on the bottom frame (50) which is configured as a single frame and on which the first compressor (11) is mounted, such addition of the second compressor (21) may require reconsideration of a layout of the first compressor (11) and the second compressor (21) on the bottom frame (50), and may also require analysis of the influence of the vibration of the second compressor (21) on the first compressor (11) every time another compressor is added, which costs time and effort.

To avoid such a situation, according to the present embodiment, the bottom frame (50) of the casing (40) is divided into a main bottom frame (51) on which the first compressor (11) is mounted and a sub bottom frame (55) on which the second compressor (21) is to be mounted.

Figure 3:
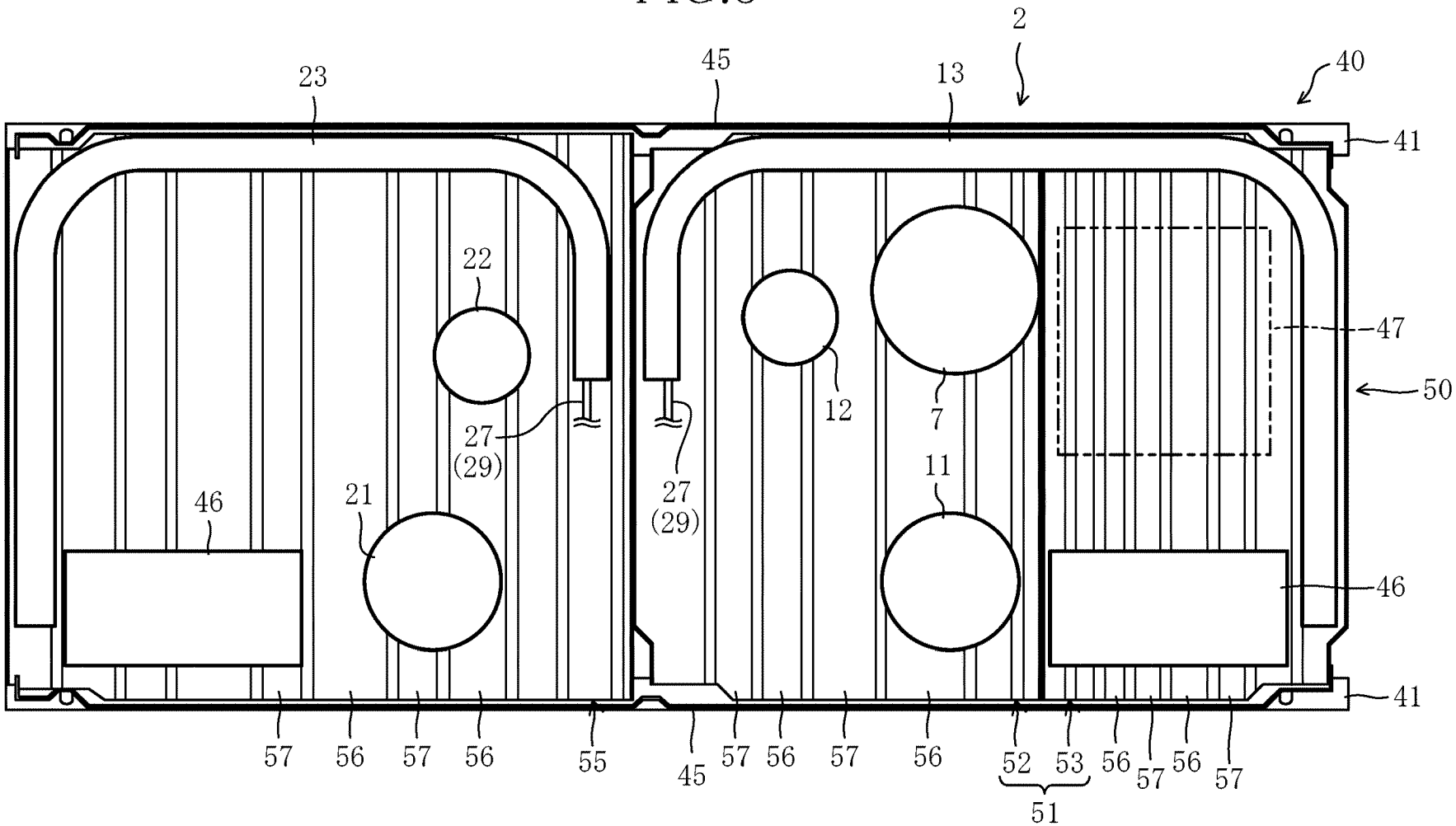
FIG. 3 is a diagram illustrating a plan view of a bottom frame and an installation leg.

As illustrated in FIG. 3, the main bottom frame (51) and the sub bottom frame (55) are arranged next to each other in the right-to-left direction (such that an extension line of the boundary between the main bottom frame (51) and the sub bottom frame (55) intersects with the front surface of the casing (40)). The front and rear end portions of the main bottom frame (51) and the sub bottom frame (55) are placed on, and supported by, the pair of installation legs (41) arranged apart from each other in the front-to-back direction.

A front end portion of the installation leg (41) on the front side and a rear end portion of the installation leg (41) on the rear side are provided with upwardly extending walls (45). The walls (45) are located outward of ends, in the front-to-back direction, of the main bottom frame (51) and the sub bottom frame (55).

The main bottom frame (51) is further divided into two left and right frames, namely, a first bottom frame (52) and a second bottom frame (53). When viewed from the front side of the casing (40), the first bottom frame (52) constitutes a left-side portion of the bottom frame (51). The first bottom frame (52) is a corrugated plate member having peaks (56) and valleys (57) extending in the front-to-back direction of the casing (40). The first compressor (11), the accumulator (7), and the first oil separator (12) are mounted on the first bottom frame (52).

When viewed from the front side of the casing (40), the second bottom frame (53) constitutes a right-side portion of the bottom frame (51). The second bottom frame (53) is a corrugated plate member having peaks (56) and valleys (57)

extending in the front-to-back direction of the casing (40). An electric component (46) which includes an inverter board, etc., and a refrigerant circuit component (47) to be replaced or added in accordance with the capability or function are mounted on the second bottom frame (53).

Examples of the refrigerant circuit component (47) include a storage container that stores a refrigerant or a refrigerating machine oil with which the refrigerant circuit (6) is filled for the first time on an installation site of the heat source unit (2), and a receiver for adding gas or liquid injection function to the first compressor (11).

The first heat-source-side heat exchanger (13) is also mounted on the main bottom frame (51) so as to be placed across the first bottom frame (52) and the second bottom frame (53). The first heat-source-side heat exchanger (13) is substantially a U-shaped heat exchanger in plan view, extending along an outer peripheral edge of the main bottom frame (51) and facing the rear and right sides of the casing (40). The first heat-source-side heat exchanger (13) substantially forms the rear and right surfaces of the casing (40).

The sub bottom frame (55) is arranged on the left of the main bottom frame (51). The sub bottom frame (55) is a corrugated plate member having peaks (56) and valleys (57) extending in the front-to-back direction of the casing (40).

The second compressor (21), the second oil separator (22), the second heat-source-side heat exchanger (23), and an electric component (46) including, e.g., an inverter board are mounted on the sub bottom frame (55). The second heat-source-side heat exchanger (23) is substantially a U-shaped heat exchanger in plan view, extending along an outer peripheral edge of the sub bottom frame (55) and facing the rear and left sides of the casing (40). The second heat-source-side heat exchanger (23) substantially forms the rear and left surfaces of the casing (40).

Connecting portions where the gas pipe (27) and the liquid pipe (29) are connected to the first and second heat-source-side heat exchangers (13) and (23) are collectively located at a middle portion of the casing (40). This configuration allows easy handling of the pipes.

The first compressor (11), the second compressor (21), and the electric components (46) are arranged close to the front side of the casing (40). This configuration can facilitate the maintenance of the first compressor (11), the second compressor (21), and the electrical components (46).

The first compressor (11) and the second compressor (21) are arranged on the main bottom frame (51) and the sub bottom frame (55), respectively, so as to be close to one of the installation legs (41) (in this embodiment, close to the front panel (81)). This configuration is intended to reduce vibration.

The heat source unit (2) according to the present embodiment therefore requires less number of work steps in adding the second compressor (21) besides the first compressor (11) in order to increase the operating capacity of the heat source unit (2). That is, it is possible to add the second compressor (21) without changing the layout of the first compressor (11).

Moreover, the heat source unit (2) according to the present embodiment makes it possible to perform vibration analyses, independently of each other in advance, of the main bottom frame (51) including the first compressor (11) and the first heat-source-side heat exchanger (13) and of the sub bottom frame (55) including the second compressor (21) and the second heat-source-side heat exchanger (23). Such vibration analyses eliminate the need to reanalyze the vibration of the device as a whole after the addition of the second compressor (21) into the casing (40). As a result, the influence of the vibration of the second compressor (21) is no longer needed to be taken into account, which contributes to improving the workability.

The division of the main bottom frame (51) into the first bottom frame (52), where the first compressor (11) is mounted, and the second bottom frame (53), where the refrigerant circuit component (47) is mounted, also contributes to improving the workability because in such a case it is only necessary to change the arrangement of the refrigerant circuit component (47) mounted on the second bottom frame (53) and the size of the casing (40) in replacing or adding the refrigerant circuit component (47) in accordance with the capability and function.

The provision of the first heat-source-side heat exchanger (13) on the main bottom frame (51), and the second heat-source-side heat exchanger (23) on the sub bottom frame (55) allows routing, in advance, of the pipes connected to the first compressor (11) and the first heat-source-side heat exchanger (13) and the pipes connected to the second compressor (21) and the second heat-source-side heat exchanger (23), and therefore eliminates the need to change the arrangement and shapes of those pipes after the second compressor (21) is added.

The main bottom frame (51) (the first bottom frame (52) and the second bottom frame (53)) and the sub bottom frame (55), each of which is comprised of a corrugated plate, contribute to the high strength of the bottom frame (50).

In a preferred embodiment, the first bottom frame (52) where the first compressor (11) is mounted and the sub bottom frame (55) where the second compressor (21) is mounted may have an increased thickness, and substantially the same thickness, as a countermeasure against vibration. On the other hand, the second bottom frame (53) where the first compressor (11) is not mounted may have a smaller thickness than the first bottom frame (52) so as to reduce the weight of the device as a whole.

INDUSTRIAL APPLICABILITY

As can be seen from the foregoing description, the present invention requires less number of work steps in adding a compressor, which is very practical and useful and therefore highly applicable in the industry.

DESCRIPTION OF REFERENCE CHARACTERS

2 Heat Source Unit
11 First Compressor
13 First Heat-Source-Side Heat Exchanger
21 Second Compressor
23 Second Heat-Source-Side Heat Exchanger
40 Casing
47 Refrigerant Circuit Component
50 Bottom Frame
51 Main Bottom Frame
52 First Bottom Frame
53 Second Bottom Frame
55 Sub Bottom Frame

The invention claimed is:

1. A heat source unit comprising a casing in which a first compressor and a second compressor are to be provided, wherein a bottom frame which constitutes a bottom surface of the casing is divided into a main bottom frame where the first compressor is to be provided and a subsidiary bottom frame where the second compressor is to be provided, and the main bottom frame is divided into a right frame and a left frame when viewed from a front side of the casing, wherein one of the right frame and the left frame is a first bottom frame where the first compressor is to be provided, and the other of the right frame and the left frame is a second bottom frame where a refrigerant circuit component is to be provided, wherein a first heat-source-side heat exchanger is provided on the first and second bottom frames of the main bottom frame and a second heat-source-side heat exchanger is provided on the subsidiary bottom frame.

2. The heat source unit of claim 1, wherein the second bottom frame has a smaller thickness than the first bottom frame.

3. The heat source unit of claim 1, wherein the second bottom frame has a smaller thickness than the first bottom frame.

4. The heat source unit of claim 1, wherein the right frames and left frames are corrugated plates having peaks and valleys extending in a front-to-back direction of the casing when viewed from the front side of the casing.

* * * * *